US010907835B2

(12) United States Patent
Johncock et al.

(10) Patent No.: US 10,907,835 B2
(45) Date of Patent: Feb. 2, 2021

(54) METHOD OF PAN DETECTION AND COOKTOP ADJUSTMENT FOR MULTIPLE HEATING SECTIONS

(71) Applicant: Whirlpool Corporation, Benton Harbor, MI (US)

(72) Inventors: James Charles Johncock, Shelbyville, MI (US); Joel Matthew Sells, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 59 days.

(21) Appl. No.: 16/260,867

(22) Filed: Jan. 29, 2019

(65) Prior Publication Data

US 2019/0154265 A1 May 23, 2019

Related U.S. Application Data

(63) Continuation of application No. 14/724,368, filed on May 28, 2015, now Pat. No. 10,228,144.

(51) Int. Cl.

| | |
|---|---|
| ***F24C 3/00*** | (2006.01) |
| ***F24C 3/12*** | (2006.01) |
| ***F24C 3/08*** | (2006.01) |
| ***F23D 14/00*** | (2006.01) |
| ***H05B 3/68*** | (2006.01) |
| *F23N 1/00* | (2006.01) |

(Continued)

(52) U.S. Cl.

CPC ..... *F24C 3/122* (2013.01); *F23D 14/00* (2013.01); *F24C 3/082* (2013.01); *F24C 3/085* (2013.01); *H05B 3/68* (2013.01); *F23D 14/06* (2013.01); *F23D 23/00* (2013.01); *F23N 1/005* (2013.01); *F23N 2241/08* (2020.01); *H05B 2213/05* (2013.01)

(58) Field of Classification Search

CPC ..... F24C 3/126; F24C 3/122; F24C 3/082; F24C 3/085; F23D 14/00

See application file for complete search history.

(56) References Cited

U.S. PATENT DOCUMENTS

| | | | |
|---|---|---|---|
| 2,155,425 | A | 4/1939 | La Mere |
| 4,214,150 | A | 7/1980 | Cunningham |
| 5,136,277 | A | 8/1992 | Civanelli et al. |

(Continued)

FOREIGN PATENT DOCUMENTS

| | | | |
|---|---|---|---|
| DE | 3619762 | A1 | 12/1987 |
| DE | 4218278 | A1 | 12/1993 |

(Continued)

*Primary Examiner* — Jason Lau

(74) *Attorney, Agent, or Firm* — Price Heneveld LLP

(57) ABSTRACT

A burner assembly for a cooktop includes a housing defining a first group of radially-spaced fuel outlets extending from an interior to an exterior of the housing, a first aperture extending through the housing and spaced outward of the first group of outlets, and a second group of radially-spaced fuel outlets extending from the interior to the exterior and spaced outward of the first aperture. A first switch assembly is mounted within the housing and includes a first pin extending upwardly through the first aperture to an end positioned above the housing. The end of the first pin is moveable in a first direction inward and outward with respect to the housing to control a direction of a first portion of a flow of fuel to the second group of outlets. A second portion of the flow of fuel is continuously directed to the first group of outlets.

7 Claims, 6 Drawing Sheets

(51) Int. Cl.
*F23D 23/00* (2006.01)
*F23D 14/06* (2006.01)

(56) References Cited

U.S. PATENT DOCUMENTS

| | | | |
|---|---|---|---|
| 5,658,478 | A | 8/1997 | Roeschel et al. |
| 5,809,990 | A | 9/1998 | Jones et al. |
| 5,893,996 | A | 4/1999 | Gross et al. |
| 6,140,617 | A | 10/2000 | Berkcan et al. |
| 6,253,761 | B1 | 7/2001 | Shuler et al. |
| 6,300,603 | B1 | 10/2001 | Edwards et al. |
| 6,325,619 | B2 | 12/2001 | Dane |
| 8,334,484 | B2 | 12/2012 | Roh et al. |
| 8,479,721 | B2 | 7/2013 | Graham et al. |
| 8,757,137 | B2 | 6/2014 | Cadima |
| 2010/0239987 | A1 | 9/2010 | Baier |
| 2012/0097148 | A1 | 4/2012 | Schoenemann et al. |
| 2013/0059256 | A1 | 3/2013 | Cadeau et al. |
| 2013/0206128 | A1 | 8/2013 | Sovar et al. |
| 2013/0255663 | A1 | 10/2013 | Cadima et al. |
| 2014/0027439 | A1 | 1/2014 | Bach et al. |
| 2014/0190467 | A1 | 7/2014 | Cadima |
| 2014/0238384 | A1 | 8/2014 | Cadima |
| 2014/0261007 | A1 | 9/2014 | Golomb |

FOREIGN PATENT DOCUMENTS

| | | | |
|---|---|---|---|
| EP | 0636841 | A2 | 2/1995 |
| EP | 0745811 | A1 | 12/1996 |
| JP | 0953827 | A | 2/1997 |
| WO | 2008031645 | A1 | 3/2008 |

METHOD OF PAN DETECTION AND COOKTOP ADJUSTMENT FOR MULTIPLE HEATING SECTIONS

CROSS-REFERENCE TO RELATED APPLICATIONS

This application is a continuation of U.S. patent application Ser. No. 14/724,368 entitled METHOD OF PAN DETECTION AND COOKTOP ADJUSTMENT FOR MULTIPLE HEATING SECTIONS, filed on May 28, 2015, now U.S. Pat. No. 10,228,144, by Johncock et al., the entire disclosure of which is incorporated herein by reference.

BACKGROUND

The present device generally relates to a burner assembly for a cooking appliance. In particular, a switch included in the burner assembly can control the use of various outlet sections of the burner in response to the size of an associated cooking article.

Burner assemblies for both gas and electric cooktops, or cooking hobs, having multiple, concentric burner segments have been developed to offer flexibility with respect to the output level of one or more cooking sections of such cooktops. In general, such burner assemblies have a smaller, inset section surrounded by a larger section, with the smaller section intended to be used alone when the burner is used to heat a relatively small cooking article. The larger section may be used in addition to the smaller section when the burner is used to heat a relatively larger cooking article. In current cooktops incorporating such burner assemblies, a control is provided that allows a user to control the heat output of the burner assembly along with the operation (on or off) of the outer large burner section. However, some users may find such controls confusing or may not properly utilize the respective sections of the burner, causing overheating or smaller cooking articles, inefficiency due to wasted heat, or other efficiency concerns. Accordingly, further advances may be desired.

SUMMARY

In at least one aspect, a burner assembly for a cooktop includes a housing defining a first group of radially-spaced fuel outlets extending from an interior to an exterior of the housing, a first aperture extending through the housing and spaced outward of the first group of outlets, and a second group of radially-spaced fuel outlets extending from the interior to the exterior of the housing and spaced outward of the first aperture. The assembly further includes a first switch assembly mounted within the housing and including a first pin extending upwardly through the first aperture to an end positioned above the housing. The end of the first pin is moveable in a first direction inward and outward with respect to the housing to control a direction of a first portion of a flow of fuel to the second group of outlets. A second portion of the flow of fuel is continuously directed to the first group of outlets.

In at least another aspect, a cooktop includes a burner unit having a first group of radially-spaced fuel outlets extending from an interior to an exterior of the housing, a first aperture extending through the housing and spaced outward of the first group of outlets, and a second group of radially-spaced fuel outlets extending from the interior to the exterior of the housing and spaced outward of the first aperture. The cooktop further includes a fuel supply line having a first portion fluidically coupled with the first group of outlets and a second portion fluidically coupled with the second group of outlets and a valve positioned within the first portion and moveable between a closed configuration when the pin is in the extended position and an open configuration when the pin is in the depressed position.

In at least another aspect, a burner assembly for a cooktop including a housing defining a center and having a first fuel outlet extending horizontally from an interior to an exterior of the housing and spaced at a first radial distance from the center, a first aperture extending vertically through the housing and spaced at a second radial distance from the center, and a second fuel outlet extending horizontally from the interior to the exterior of the housing and spaced a first radial distance from the center. The second radial distance is greater than the first radial distance, and the third radial distance is greater than the second radial distance. The assembly further includes a first switch assembly mounted within the housing and including a first pin extending upwardly through the first aperture to an end positioned above the housing, the end of the first pin being moveable in a first direction inward and outward with respect to the housing. A fuel supply line has a first portion fluidically coupled with the first fuel outlet and a second portion fluidically coupled with the second fuel outlet, and a valve is positioned within the second portion and moveable between a closed configuration when the pin is in the extended position and an open configuration when the pin is in the depressed position.

These and other features, advantages, and objects of the present device will be further understood and appreciated by those skilled in the art upon studying the following specification, claims, and appended drawings.

DETAILED DESCRIPTION OF EMBODIMENTS

Figure 1:
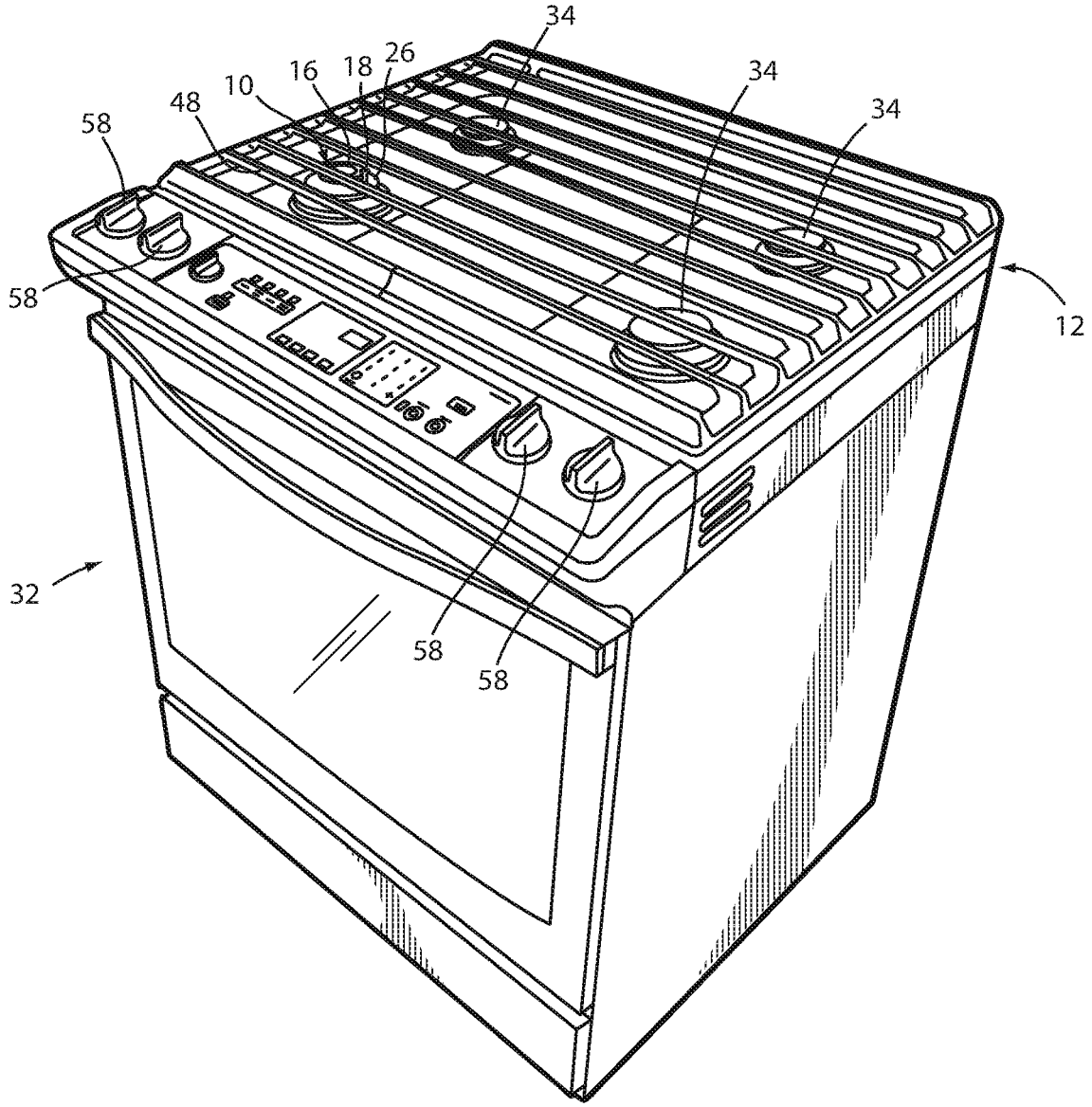
FIG. 1 is a perspective view of a cooking appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-6, reference numeral 10 generally designates a burner assembly for a cooktop 12. Burner assembly 10 includes a housing 14 defining first and second concentric outlet sections 16, 18 (which may also be referred to as burner sections 16, 18). The first outlet section 16 is inset relative to the second outlet section 18, and housing 14 further defines a first aperture 20 between the first outlet section 16 and the second outlet section 18. The burner assembly 10 further includes a first switch assembly 22 mounted within housing 14 and including a lever 24 coupled with housing 14 and first pin 26 extending from the lever 24 and upwardly through the aperture 20 to an end position 28 above the housing 14. The end 28 of pin 26 is moveable at least in a first direction 30 inward and outward with respect to the housing 14 by rotation of lever 24.

Figure 2:
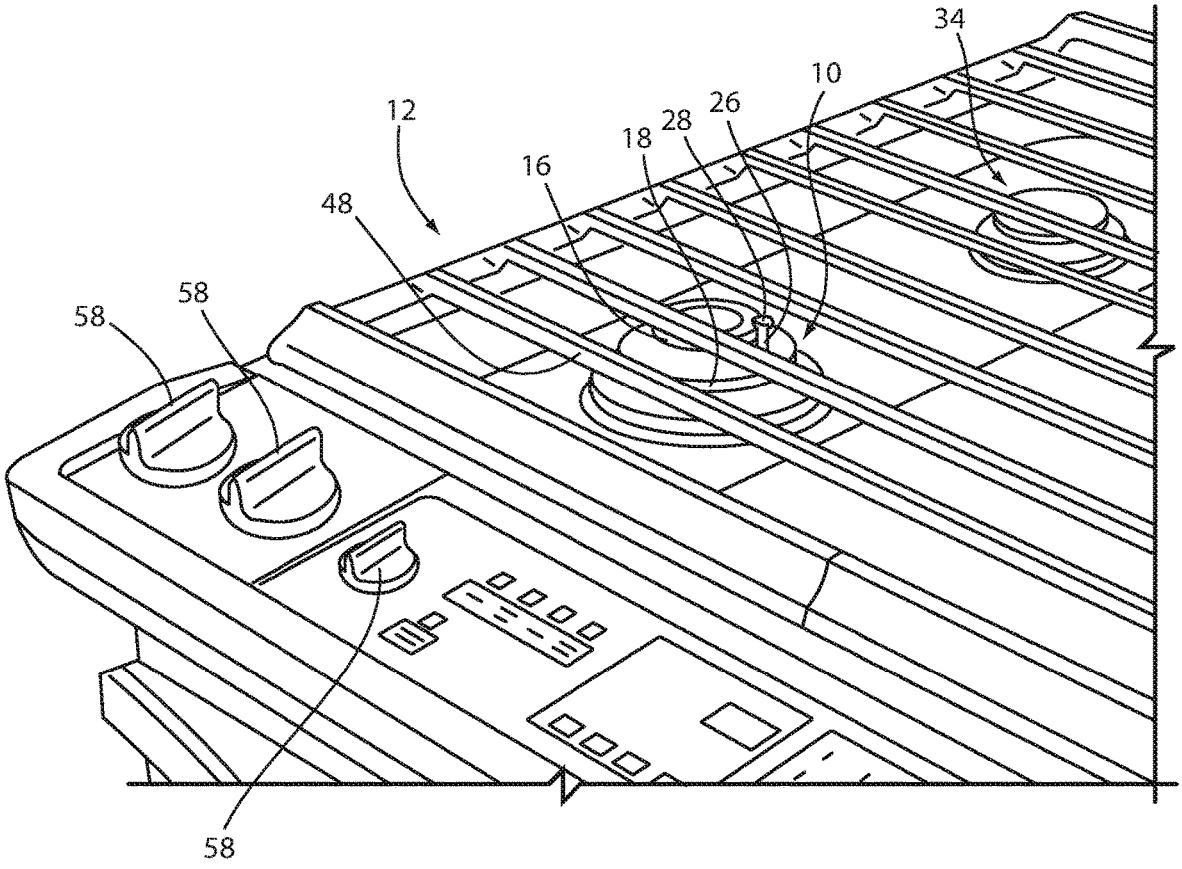
FIG. 2 is a detail perspective view of a burner assembly included in a cooktop of the appliance of FIG. 1.
Figure 3:
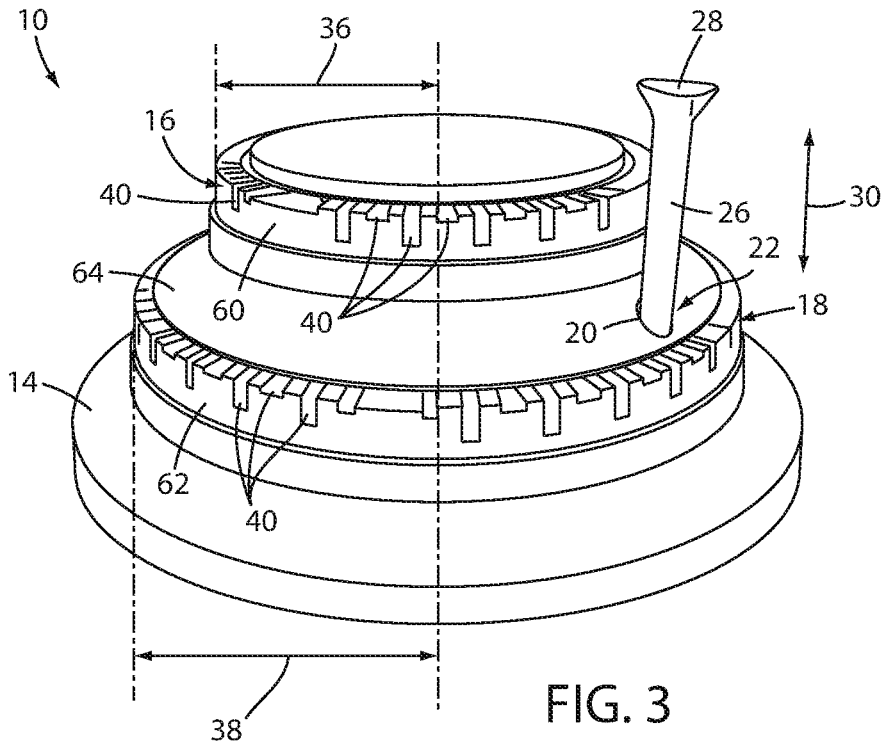
FIG. 3 is a detail view of the burner assembly.
Figure 4:
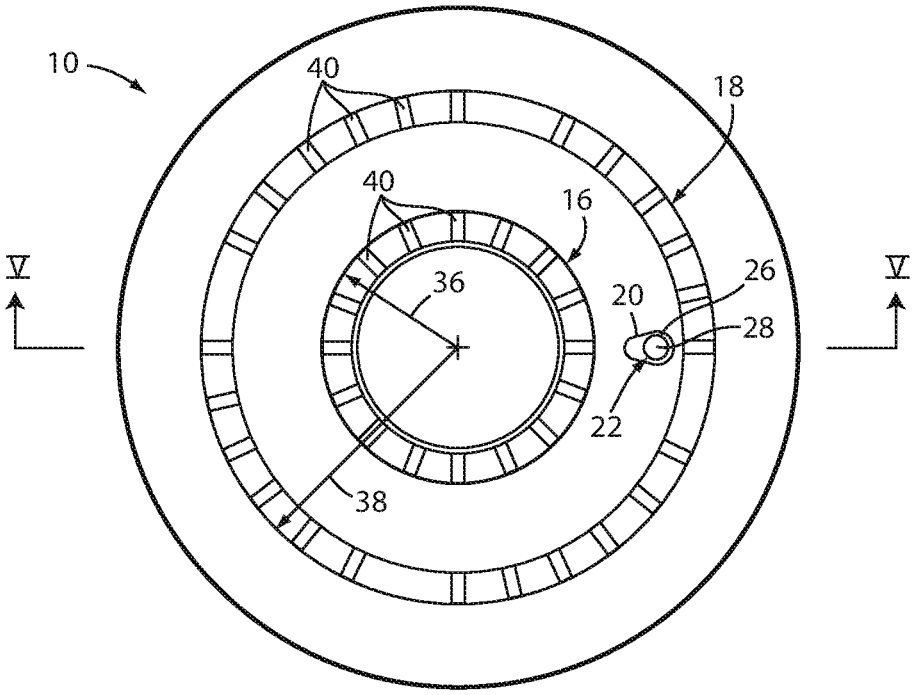
FIG. 4 is a top view of the burner assembly of FIG. 3.

As further shown in FIGS. 1 and 2, burner assembly 10 can be usable in a cooktop 12 that can be either in the form of a standalone cooking hob or can be configured as part of an appliance 32 such as a range or the like. In any of these examples, cooktop 12 can be a gas-powered cooktop 12 in which burner assembly 10 and additional burners 34 are configured to provide a heat source for cooking by the burning of the fuel source provided thereto. In various examples, the fuel source can be natural gas, propane, or the like. Further, burner assembly 10, which is shown in an exemplary form herein, can be a multi-section burner of the type generally known, and modified according to the disclosure herein. As illustrated, the multi-section burner assembly 10 includes the aforementioned first outlet section 16 and second outlet section 18, in which first outlet section 16 and second outlet section 18 are concentrically arranged within burner assembly 10 with first outlet section 16 having a first radius 36 that is smaller than a second radius 38 of second outlet section 18. As an alternative, cooktop 12 can be an electric cooktop in which first outlet section 16 and second outlet sections 18 are resistive heating elements that are powered by a flow of electricity thereto.

In the present example, both first outlet section 16 and second outlet section 18 include a plurality of fuel outlets 40 arranged therearound through which the fuel is output for burning to provide cooking heat. By including both first outlet section 16 and section outlet section 18 of the above-described varying radii 36, 38, burner assembly 10 is configured such that a single burner assembly 10 can act as what would generally be considered a small burner or a large burner, providing flexibility to the cooking configuration provided by cooktop 12. In general, first radius 36 may be between about 0.75 in and 1.25 in, although other dimensions are possible based on the particular configuration of burner assembly 10. Similarly, second radius 38 may be between about 1.5 in and 2.5 in or, alternatively, between 150% and about 300% of the size of first burner radius 36. Again, such ranges are merely exemplary and various other relative dimensions and configurations of first outlet section 16 and second outlet section 18 may be utilized in a burner assembly 10 according to the further aspects of the present disclosure, discussed further herein. An embodiment of burner assembly 10 including electric outlet sections 16, 18 can be similarly arranged with respect to the various sizes of outlet sections 16, 18 described herein with the exception that, whereas in a gas burner assembly 10 outlet sections 16, 18 are vertically spaced, outlet sections 16,18 in an electric burner assembly may be vertically even or flush.

Figure 5:
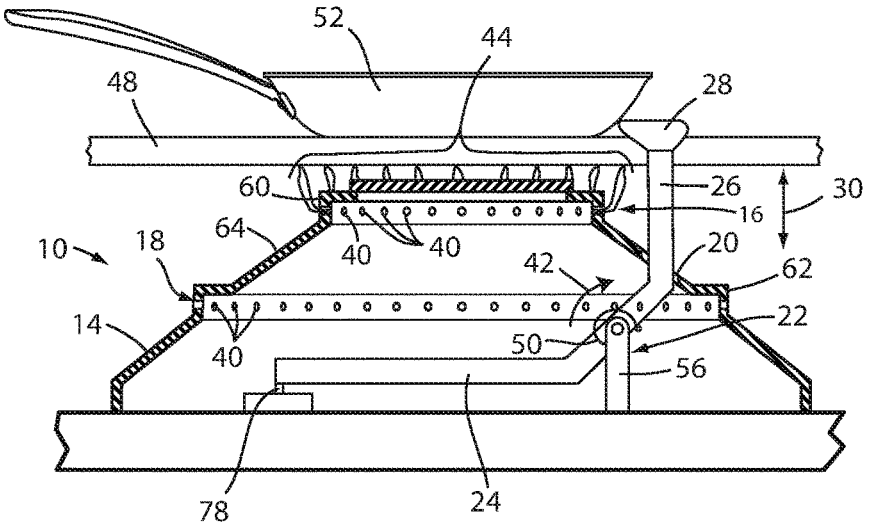
FIG. 5 is a side cross-section view of the burner assembly of FIG. 3, taken along line V-V in FIG. 4 and shown in a first operating condition.
Figure 6:
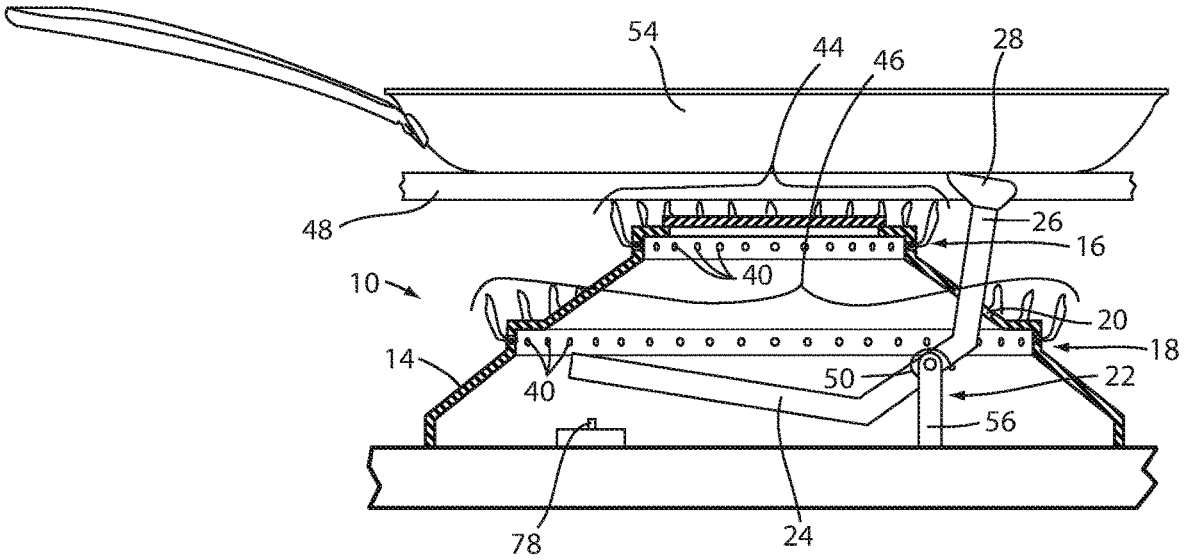
FIG. 6 is the side cross-section view of FIG. 5, shown in a second operating condition.

In general, the different outlet sections 16, 18 of burner assembly 10, as illustrated in FIGS. 1-6 are usable according to a first usage mode, in which first outlet section 16 can be provided with fuel that can be ignited to provide an inner flame 44 that can extend outwardly from first outlet section 16 over a first area. Optionally, additional fuel can be provided to second outlet section 18 that can also be ignited and burned, in a second usage mode, to provide an outer flame 46 that extends outwardly from second outlet section 18 over a second area that, as shown in FIG. 6, can extend outwardly from the area occupied by inner flames 44. In this manner, burner assembly 10 may operate in a generally-accepted manner, in which the size of the flame area outputted by the burner assembly 10 can generally correspond with the size of the cooking article positioned thereover. That is, for reasons of efficiency, and the like, it may be desired to provide a flame output from a burner assembly 10 that does not occupy a larger area than associated cooking article, e.g. cooking article 52, as shown in FIG. 5. In other words, it is desired that a flame output of a burner assembly 10 not extend outwardly from an associated cooking article, such as cooking article 52. On the other hand, to take advantage of the cooking area provided by a relatively larger cooking article (e.g. cooking article 54 in FIG. 6) it may be desired to provide a flame output covering both inner portion and outer portions of the cooking article, including portions that may extend outwardly beyond a flame corresponding to the size of a smaller cooking article 52. In this manner, burner assembly 10 may be usable in a first condition, in which only inner flame 44 is output from burner assembly 10, and, specifically, from out of first outlet section 16. Such a usage mode can be used to provide only inner flame 44 so as not extend outwardly beyond the area of cooking article 52. Alternatively, when burner assembly 10 is used to heat larger cooking article 54, as shown in FIG. 6, both inner flame 44 can be provided by first outlet section 16 and outer flame 46 can be provided by second outlet section 18 to provide even, and generally adequate, heat for cooking article 54. An electric burner 10 configuration having separate inner 16 and outer 18 outlet sections may operate according to similar principles, in which, for efficiency purposes and the like, it may be desired to not power any heating element sections that extend outwardly beyond the edges of an associated cooking article.

As shown in FIGS. 3-6, first outlet section 16 and second outlet section 18 can be defined in respective cylindrical (or annular) sections 60 and 62 that correspond to generally vertical segments of housing 14, through which fuel supply outlets 40 extend. As further shown, housing 14 can define an intermediate section 64 extending between inset cylindrical section 60 and outer cylindrical section 62. In an embodiment, aperture 20 through which pin 26 extends can be positioned within intermediate segment 64 of housing 14 such that pin 26 is, similarly, positioned between first outlet section 16 and second outlet section 18. As further shown in FIGS. 3 and 4, aperture 20 can be formed toward an outer end of intermediate segment 64 such that pin 26 is similarly positioned. This location of pin 26 with respect to first and second outlet sections 16 and 18, can be such that a cooking article of a first size category, such as corresponding generally with a relatively small cooking article 52 will not contact pin 26 when placed on grate 48, but that a cooking article within a second size category, for example corresponding to a larger cooking article 54 will contact pin 26 and move pin 26 into the depressed position shown in FIG. 6 when placed on grate 48. In general, the first size category may correspond to cooking articles 52 that have a diameter that is less than the output area of second outlet section 18, and cooking articles 54 of the second sized category may be as large as the output area of the second outlet section 18 or larger.

As further illustrated in FIGS. 5 and 6, the incorporation of switch assembly 22, including pin 26, may allow for burner assembly 10 to automatically adapt between the aforementioned usage modes. In particular, this adaptation may include the provision of inner flame 44 alone or in connection with outer flame 46, depending on the size of the cooking article 52 or 54 used in connection with burner assembly 10. In particular, as shown in FIG. 5, cooktop 12 can further include a grate 48 that extends in a generally lateral direction (e.g. perpendicular to first direction 30) over burner assembly 10. As shown, pin 26 can be configured such that end 28 thereof extends to a position generally vertically above an upper surface of grate 48 (e.g. a surface upon which a cooking article 52 or 54 rests when used in associated with burner assembly 10). In particular, switch assembly 22 may be spring-biased such that pin 26 is disposed in the position shown in FIG. 5 when at rest. This may be accomplished by incorporating a spring 50 into a coupling location between lever 24 and a corresponding mounting bracket 56 of lever 24. Accordingly, cooktop 12 can be configured to provide a flow of fuel, as described above, only to first outlet section 16 when pin 26 is in the upward, or rest, position shown in FIG. 5. Additionally, cooktop 12 can include a plurality of controls 58, at least one of which may be associated with the fuel supply for burner 10. This particular one of controls 58 can be used to adjust the fuel flow provided to burner assembly 10 within a predetermined range to adjust the heat output and size of flame per output by burner assembly 10. In this manner, when a relatively small cooking article 52 is in use on grate 48 in association with burner assembly 10, pin 26 is not contacted by cooking article 52. Accordingly, burner assembly 10 only outputs inner flame 44 to provide an appropriate level of heat, within the user controlled range permitted by control 58, for use of cooking article 52.

As shown in FIG. 6, when a relatively larger cooking article 54 is positioned on grate 48, cooking article 54 will contact upper end 28 of pin 26, thereby causing pin 26 to be depressed downwardly in first direction 30 and into aperture 20 such that end 28 is generally even or level with grate 48. According to a control scheme discussed further below, such depressing of pin 26 can cause cooktop 12 to provide the flow of fuel to second outlet section 18, in addition to first outlet section 16, thereby allowing outer flame 46 to ignite. When burner assembly 10 is operating in the mode shown in FIG. 6, manipulation of the particular one of controls 58 associated with burner assembly 10 can be used to control the particular level of fuel provided to second outlet section 18, in addition to first outlet section 16 to control the heat output thereof, which influences the size of outer flame 46 in addition to inner flame 44. This allows the overall size of the output of burner (in the form of flames produced thereby) to correspond to respective first and second (i.e. smaller and larger) area ranges or associated cookware articles 52 and 54. Further, if cooking article 54 is removed from grate 48, the spring biasing of pin 26 toward the upward position illustrated in FIG. 5 will cause pin 26 to move end 28 away from housing 14 to return to the rest position, at which time the flow of fuel to second outlet section 18 will be cut off, and fuel will only be provided, again, to first outlet section 16, thereby disabling outer flame 46.

Figure 7:
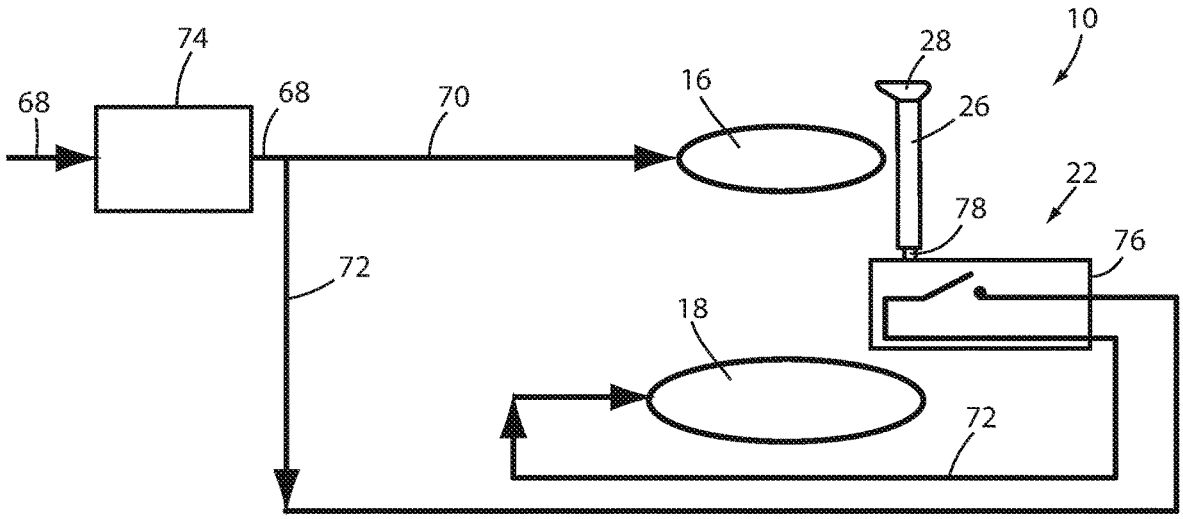
FIG. 7 is a schematic representation of a control system useable for controlling the operation of the burner assembly between the operating conditions depicted in FIGS. 5 and 6.

In FIG. 7, burner unit 10 is depicted schematically in connection with additional features and components of cooktop 12 that can enable the above-described control of the usage of first outlet section 16 and second outlet section 18. It is noted that the scheme shown can be used to illustrate the principles of such operation with respect to either a gas or electric cooktop 12. With respect to a gas cooktop 12, as illustrated in FIGS. 1-6, structures for controlling the flow of fuel to burner assembly 10, including to first outlet section 16 and, selectively, to outlet section 18 is illustrated. In particular, cooktop 12 can include a fuel supply line 68 that has a supply valve 74 associated with a particular one of controls 58. Downstream of supply valve 74, fuel supply line 68 branches into a first portion 70 and a second portion 72. As shown, first portion 70 fluidically couples with first outlet section 16 such that when supply valve 74 is in an open position within a range of open positions corresponding to fuel supply levels of supply valve 74, a flow of fuel is provided thereto. As further shown in FIG. 7, second portion 72 of fuel supply line 68 fluidically couples with second outlet section 18 to provide a flow of fuel thereto that also corresponds with a range of fuel supply levels provided by supply valve 74. Between supply valve 74 and second outlet section 18, second portion 72 of fuel supply line 68 has a cutoff valve 76 associated therewith for controlling whether or not a flow of fuel provided by supply valve 74 through second portion 72 of fuel supply line 68 is permitted to pass to second outlet section 18.

As further shown, cutoff valve 76 is operably associated with pin 26. In particular, cutoff valve 76 is associated with pin 26 such that when pin 26 is in the upward position (e.g. corresponding to FIG. 5) cutoff valve 76 is in a closed position, thereby preventing the flow of fuel to second outlet section 18. Such operable association can include directly coupling pin 26 with cutoff valve 76 such that movement of pin 26 directly physically manipulates cutoff valve 76. In another example, cutoff valve 67 can include a button 78 (or other similar manipulation structure referred to herein as a button) thereon that can be positioned so as to be manipulated by pin 26 or another portion of switch assembly 22 such as lever 24, for example. Further, cutoff valve 76 is associated with pin 26 such that when pin 26 is moved into the depressed position (e.g. corresponding to FIG. 6), indicating the presence of a relatively larger cooking article 54 in association with burner assembly 10, cutoff valve 76 is in an open position, thereby allowing the flow of fuel dictated by supply valve 74 to be further provided to second outlet section 18. In this manner, pin 26 can be used, as described, to detect the size of a cooking article 52 or 54 associated with burner 10 to provide an output for burner assembly 10 that generally correspond to the detected size of cooking article 52 or 54.

In an alternative embodiment, pin 26 can be associated with a button, or other electromechanical switch that can be used to send a signal to an electronic control that can be used to electronically control the position of an electromechanical cutoff valve 76 that can be similarly associated with second portion 72 of fuel supply line 68. In a further alternative embodiment, cooktop 12 can be controlled at least partially by a controller or an electronic control system, such as an on-board computer or the like, in which a similar electromechanical button or switch associated with pin 26 can be used by such a control system to control the flow fuel to second outlet section 18, as needed based on a detection of pan size by pin 26 in a manner similar to that which is described above.

In an implementation of the schematic depiction of FIG. 7, cutoff valve 76 can be positioned adjacent to a portion of lever 24 such that a control button 78 thereof can be manipulated by lever 24, depending on the position of pin 26 associated therewith. As shown in FIG. 5, such interaction can be such that when pin 26 is in the upward position, valve control button 78 is in a depressed condition, which can correspond to a closed position of cutoff valve 76. Similarly, when pin 26 is moved into the depressed position, lever 24 can allow button 78 to move to upward position, which can corresponding to an open condition of cutoff valve 76. In an alternative embodiment, pin 26, itself, can replace or directly connect with valve button 78, to control opening and closing of cutoff valve 76, in a manner similar to that which is depicted schematically in FIG. 7. Further, in connection with an embodiment of cooktop 12 using at least partial electronic control, lever 24 can interact with a variation of button 78 that is part of an electromechanical button or switch arrangement configured, as discussed above, for sending a signal thereto to cause the control of cooktop 12 to selectively manipulate the positioning of cutoff valve 76.

In an alternative embodiment, in which burner assembly 10 is an electric burner assembly, the depicted control scheme can be used to control the flow of electricity to second outlet section 18 for powering thereof. In this manner, the respective flows of electricity and fuel discussed herein can be generically referred to as an energy supply when referring generically to the control scheme depicted in FIG. 8 or with respect to the control method implemented thereby. In particular, supply line 68 can be an electrical supply line in the form of a wire or the like, with first portion 70 connecting with first outlet portion 16 for providing power thereto for heating in accordance with an output selection by an associated control 58. Second portion 72 of supply line 68 can be coupled with a portion of switch assembly 22 that can be modified such that the previously-described button 78 can be associated with an electromechanical switch for connecting or disconnecting supply line 68 with second outlet portion 18 for selectively providing electricity thereto in response to a large cooking article 54 depressing pin 26.

Figure 8:
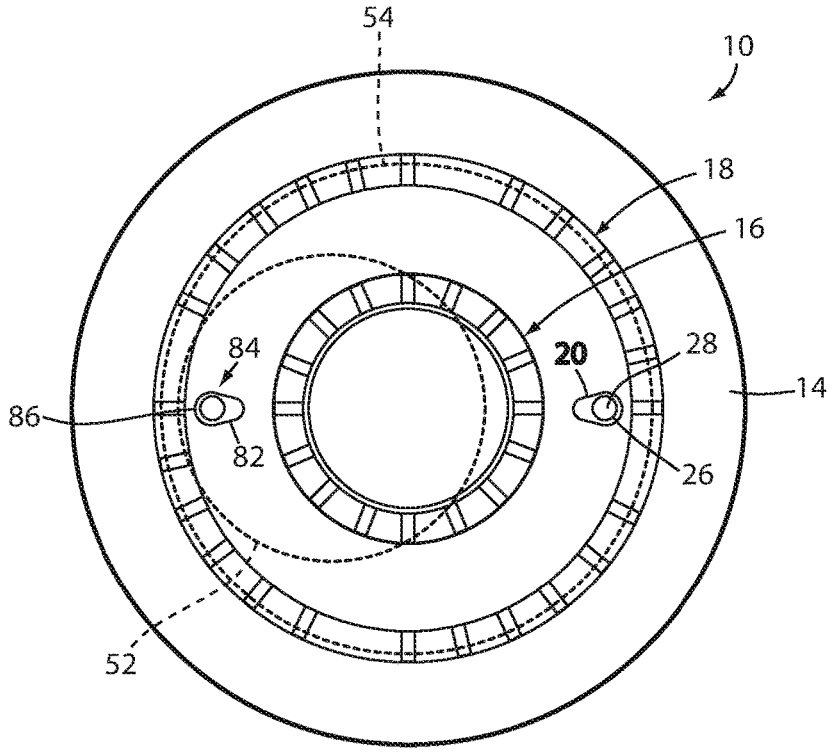
FIG. 8 is a top view of a variation of the burner assembly of FIG. 3.

As shown in FIG. 8, a variation of the burner assembly 10 discussed above with reference to FIGS. 1-7 is illustrated, in which housing 14 includes a plurality radially-spaced apertures 20, each with a corresponding pin 26 extending therefrom, each pin 26 being associated with a separate switch assembly 22 that is similar to the switch assembly 22 discussed above. The presence of two radially-spaced pins 26 may provide functionality in which burner assembly 10 can be prevented from falsely detecting a relatively large cooking article 54 when, in reality, a small cooking article 52 is in place on grate 48 in an offset position with respect to burner assembly 10, as shown in FIG. 8. As shown, such an offset small cooking article 52 could be positioned in contact with a single pin 26, thereby causing a false detection of a large cooking article 54. However, the presence of two radially-spaced pins 26 can prevent such false detection, by requiring that both pins 26 be moved into a depressed position before fuel is provided to second outlet section 18. As shown in FIG. 8, a relatively small cooking article 52 cannot contact both pins 26, even when offset. Conversely, a relatively large cooking article 54 can be positioned on grate 48 over burner assembly 10 so as to contact and depress both pins 26, thereby causing burner 10 to provide fuel to both first outlet section 16 and second outlet 18 in a manner similar to that which is described above.

Figure 9:
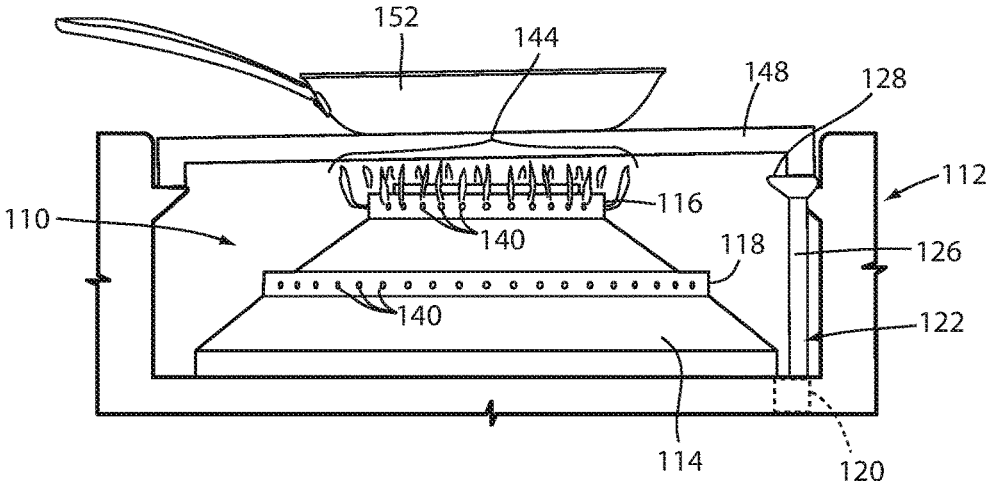
FIG. 9 is a side view of an alternative burner assembly shown in a first operating condition.
Figure 10:
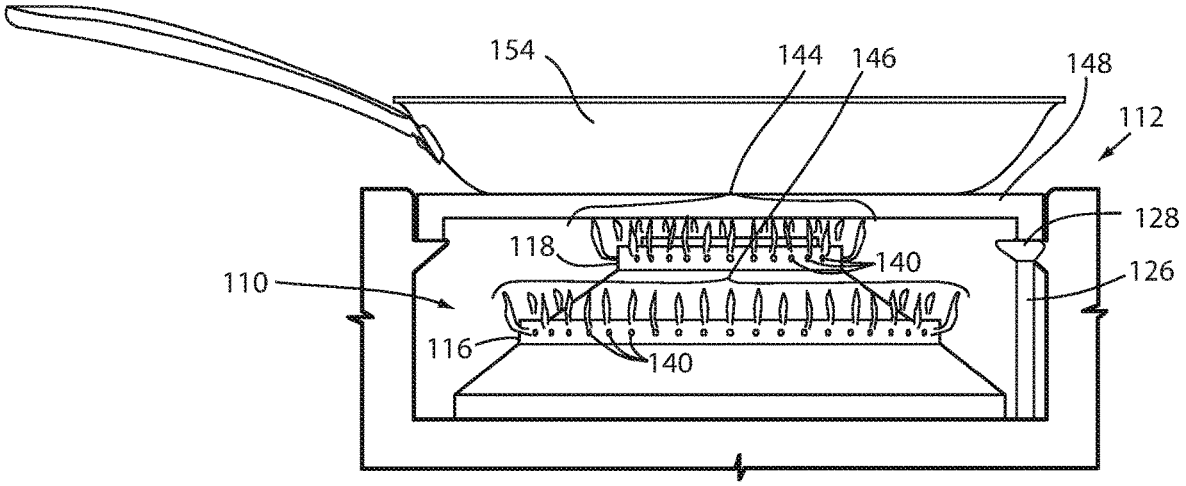
FIG. 10 is a side view of the burner assembly of FIG. 9, shown in a second operating condition.

An alternative embodiment for a burner assembly 110 usable in connection with a cooktop 112 is shown in FIGS. 9 and 10. As shown, such a variation of cooktop 112 can include a pin 126 positioned remote from burner assembly 110 and in a position so as to support a portion of grate 148 associated with burner assembly 110. In this manner, the spring biasing of pin 126 can be tuned such that movement of pin 126 from an extended position to a depressed position can correspond to the weight of a cooking article 152 or 154 positioned on grate 148. Accordingly, the size category of a cooking article 152 or 154 can be estimated based on the weight of such a cooking article 152 or 154 being above or being below a predetermined threshold corresponding to the tuning of the spring-biasing of pin 126.

As illustrated in FIG. 9, a relatively small cooking article 152, when placed on grate 148 may have a weight insufficient to cause downward movement of pin 126 under the combined weight of cooking article 152 and grate 148 when the weight of cooking article 152 is applied to grate 148. In this case, pin 126 will remain in the upward, or rest, position and any fuel provided to burner assembly 110 will only be provided to first outlet section 116 thereof. Further, as shown in FIG. 10, the presence of a relatively large cooking article 154 on grate 148 can result in a combined weight of cooking article 154 and grate 148 sufficient to cause pin 126 to move into the depressed position, thereby allowing an additional flow of fuel to second outlet section 118 and corresponding ignition of outer flame 146 sufficient to provide cooking heat to large cooking article 154.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A burner assembly for a cooktop, comprising:

a housing defining:

a first group of radially-spaced fuel outlets extending from an interior to an exterior of the housing;

a first aperture extending through the housing and spaced outward of the first group of outlets; and a second group of radially-spaced fuel outlets extending from the interior to the exterior of the housing and spaced outward of the first aperture; and a first switch assembly mounted within the housing and including a first pin extending upwardly through the first aperture to an end positioned above the housing, the end of the first pin being moveable in a first direction inward and outward with respect to the housing to control a direction of a first portion of a flow of fuel to the second group of outlets, a second portion of the flow of fuel being continuously directed to the first group of outlets.

2. The burner assembly of claim 1, wherein the first switch assembly further includes:

a lever rotatably mounted within the housing, the first pin extending upwardly from the lever; and a button operably arranged with respect to the lever such that movement of the first pin between an upward position and a downward position moves the button between a first position and a second position.

3. The burner assembly of claim 2, wherein the first and second positions of the button are respectively associated with the direction of the first portion of the fuel flow to the second group of outlets being closed and open.

4. The burner assembly of claim 2, further including a supply line in fluidic communication with the first and second concentric outlet sections for providing the flow of energy thereto in the form of fuel, the supply line including a valve between the supply line and the second outlet section for selectively closing and opening the fluidic communication therebetween; wherein the button is coupled with the valve such that the fluidic communication between the fuel supply line and the second outlet section is closed when the first pin is in the upward position and open when the first pin is in the downward position.

5. The burner assembly of claim 1, further including a grate positioned above the housing, wherein:

the first pin is moveable toward and away from the housing between an upward position and a downward position, the end of the first pin being positioned above the grate when the first pin is in the upward position and being generally level with the grate when the first pin is in the downward position.

6. The burner assembly of claim 1, wherein the housing defines a second aperture between the first and second groups of outlets, the second aperture being radially spaced from the first aperture about the first group of outlets, the burner assembly further including:

a second switch assembly mounted within the housing and including a second pin extending upwardly through the second aperture.

7. The burner assembly of claim 1, wherein the first pin is spring-biased outward with respect to the housing in the first direction.

* * * * *